US009743746B2

(12) United States Patent
Martinez et al.

(10) Patent No.: US 9,743,746 B2
(45) Date of Patent: Aug. 29, 2017

(54) DEVICE FOR CARRYING A PLURALITY OF HANDBAGS

(71) Applicants: Javier Martinez, Corpus Christi, TX (US); Alan Schnaufer, Corpus Christi, TX (US)

(72) Inventors: Javier Martinez, Corpus Christi, TX (US); Alan Schnaufer, Corpus Christi, TX (US)

(73) Assignee: Coastal Business Solutions, LLC, Corpus Christi, TX (US)

( * ) Notice: Subject to any disclaimer, the term of this patent is extended or adjusted under 35 U.S.C. 154(b) by 0 days.

(21) Appl. No.: 15/123,133

(22) PCT Filed: Mar. 2, 2015

(86) PCT No.: PCT/US2015/018318

§ 371 (c)(1),
(2) Date: Sep. 1, 2016

(87) PCT Pub. No.: WO2015/167662

PCT Pub. Date: Nov. 5, 2015

(65) Prior Publication Data

US 2017/0065068 A1 Mar. 9, 2017

Related U.S. Application Data

(60) Provisional application No. 61/947,114, filed on Mar. 3, 2014.

(51) Int. Cl.
*B65D 33/06* (2006.01)
*A45F 5/10* (2006.01)

(52) U.S. Cl.
CPC ..... *A45F 5/102* (2013.01); *A45F 5/1026* (2013.01); *A45F 2005/104* (2013.01); *A45F 2005/1033* (2013.01)

(58) Field of Classification Search
CPC ..... A45F 5/102; B65D 33/06
USPC ..... 294/137, 158, 159, 170, 171; D9/434; 383/6, 13, 25
See application file for complete search history.

(56) References Cited

U.S. PATENT DOCUMENTS 3,680,752 A * 8/1972 Wilson ..... A45F 5/10 294/171
4,420,178 A * 12/1983 Taylor ..... A45F 5/1026 229/117.19
4,993,767 A * 2/1991 Song ..... A47J 45/10 220/736
5,181,757 A 1/1993 Montoya
D358,094 S 5/1995 Degiacomo, Jr.
5,441,323 A 8/1995 Goddard
5,447,259 A * 9/1995 Erickson ..... A45F 5/10 220/759

(Continued)

*Primary Examiner* — Paul T Chin
(74) *Attorney, Agent, or Firm* — M. Susan Spiering; Ferrell's PLLC

(57) ABSTRACT

A rigid or semi-rigid device for carrying at least one, and preferably a plurality of handbags is provided. The device includes a handle, an elongated portion integrated with the handle through a middle portion and a pair of hooks. The hooks are angled upwardly to extend at least up to the height of the handle and are configured to smoothly receive the plurality of handbags and retain the handbags in the space in such a way that the plurality of bags remains parallel to the body of the person.

9 Claims, 3 Drawing Sheets

(56) References Cited

U.S. PATENT DOCUMENTS

| | | | | | |
|---|---|---|---|---|---|
| 5,487,581 | A | | 1/1996 | Carmo | |
| 5,507,544 | A | * | 4/1996 | McQuade | A45F 5/10 220/759 |
| 5,667,266 | A | | 9/1997 | Giocanti | |
| 5,797,166 | A | | 8/1998 | Wagenheim | |
| 5,992,803 | A | * | 11/1999 | LeRoux | A45F 5/1026 248/100 |
| D441,653 | S | * | 5/2001 | LeRoux | D9/434 |
| D448,665 | S | * | 10/2001 | Lenczowski | D9/434 |
| 6,382,549 | B1 | * | 5/2002 | Krake | A45F 5/102 242/405.2 |
| 6,499,781 | B1 | * | 12/2002 | Flynn | A45F 3/10 294/159 |
| D643,991 | S | * | 8/2011 | Miller | D34/28 |
| 2004/0145203 | A1 | * | 7/2004 | Caputi | A45F 3/14 294/170 |
| 2006/0192401 | A1 | * | 8/2006 | Sewell | A45F 5/102 294/159 |

* cited by examiner

DEVICE FOR CARRYING A PLURALITY OF HANDBAGS

CROSS REFERENCE TO RELATED APPLICATION(S)

This U.S. non provisional patent application is based on copending PCT/US2015/018318, entitled "Carrier Device", filed Mar. 2, 2015, and U.S. Provisional Patent Application Ser. No. 61/947,114, entitled "Handbag Carrier Device", filed Mar. 3, 2014, the priority of both which is hereby claimed and the disclosure of which is incorporated herein by reference in their entirety.

BACKGROUND

Field of the Invention

The present invention relates generally to handheld devices for holding items having handles, bags in general, carry-bags or handbags. More particularly, the present invention relates to an ergonomic handle to easily carry one or more bags or item at a time.

Description of the Related Art

In various day to day activities, such as carrying groceries and other items purchased from shopping centers, people carry bags, commonly referred to as handbags, plastic bags (with built in handles), reusable bags, purses, tote bags, and the like. Typically, a handbag includes a pouch for holding various items, and a hand strap connected with the pouch. These handbags are normally made of plastics, such as polyethylene, or polypropylene, or can be made from other textiles such as canvas, leather, cotton or cotton blend textiles and the like. It is very common that a person is required to carry several bags at one time, which increases the overall weight carried by the person, or the bulk from carrying multiple bags.

One of the primary complaints of those who engage in the common practice of carrying several heavy bags is that the handles of the bags exert great pressure on their hands.

The weight of the bags may also result in tiring the person. In a few cases, the weight of the handbag results in breaking of the hand straps. It may also result in muscular injury to the person carrying the handbag if it is not carried properly. Additionally, when numerous handbags need to be moved from one position, or location, to another, it will take various trips to and fro to transport all the bags. It is desirable to minimize the number of trips needed to transport the numerous bags from one location to another.

Accordingly, numerous handgrips, hanger devices, and related tools have been developed to ease the task of carrying handbags. For example, U.S. Pat. No. 5,487,581 assigned to Carmo et al. describes a hand grip for carrying bags which contains a single hook for holding the bags. Single hooks, as described in Carmo, however are not able to provide proper weight distribution in the case of carrying multiple bags. While US'581 illustrates a two-hook handgrip, the design does not easily allow for carrying multiple bags on one hook or distribute weight evenly for ease in carrying. U.S. Design Pat. No. D340,863 assigned to Daigle illustrates a carrier for plastic grocery bags, but the number of bags which can be carried is limited to 4 in this design.

U.S. Pat. No. 5,667,266 issued to Giocanti discloses a grip for carrying bags with loop handles with ends shaped to form hooks for carrying the bags and that is capable of being carried by hand or on a shoulder or forearm. However, a user cannot easily remove the device from his shoulder or forearm since this device has a "low" profile when slung over a shoulder or forearm and while also supporting the weight of the bags. Further, a user must direct the bags over the round boss to secure them in the hook and this can lead to a weak point at the boss based on frequency of use.

U.S. Pat. No. 5,441,323 issued to Goddard discloses a carrier for bags having straps, comprising a handgrip portion with an article carrier portion cantilevered from one end thereof. A ring is used to close the opposite end of the two portions. However, this design has an asymmetric configuration which results in the highest portion of the hand actually supporting a disproportionate share of the load, as the closed end rests against the little finger of the hand. Other designs have been developed in the past to overcome the problems or differences mentioned above. However, it has been found that the designs of current devices for carrying items include the problems of weight mis-distribution, and result in non-balance of the user during use of the item. In light of the foregoing, there exists a need to provide a device that overcomes one or more shortcomings of hand grips described in the prior art.

SUMMARY

Disclosed herein is a single/monolithic (defined to mean a single piece) device useful for carrying one or more bags or items having handles or clips (such as in clothes hangers). Provided within the device is an ergonomic handle having optional indentations thereon for finger placement, upwardly elongated hooks for ease in sliding and securing the bag/item(s) onto the carrier, and a flattened area for weight distribution when carrying multiple bags, or other items having a handle.

An embodiment of the invention provides a monolithic device for carrying at least one, but preferably a plurality of handbags. The device includes a handle, an elongated portion integrated with the handle through a middle portion, or middle section, and a pair of hooks integrated with the elongated portion. The handle defines an opening configured to receive fingers of a person's hand there through.

This opening may be smooth, or indented to cup the fingers holding it. The handle is configured to be gripped by the fingers properly and evenly resulting in better weight distribution of the bags placed thereon. The elongated portion is substantially horizontal along the length of the device and is placed to define a space properly and evenly between the handle and the elongated portion. The first hook and the second hook are angled upwardly to extend up to the height of the handle. The first hook and the second hook are further configured to smoothly receive the plurality of handbags and retain the handbags in the space in such a way that the plurality of bags preferably remains parallel to the body of a person.

BRIEF DESCRIPTION OF DRAWINGS

The invention is described in detail below with reference to the drawings wherein.

DETAILED DESCRIPTION OF EMBODIMENTS

Figure 1:
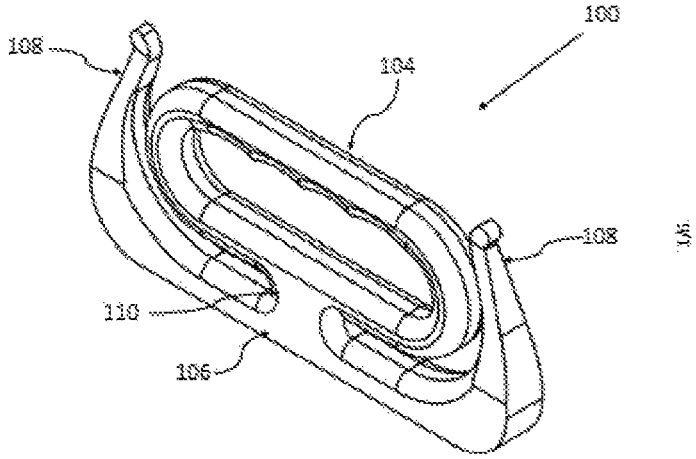
FIG. 1 is a view of the device for carrying a plurality of hand bags.

The invention is described in detail below in connection with the Figures for purposes of illustration, only. The invention is defined in the appended claims. Terminology used throughout the specification and claims herein are given their ordinary meanings. As used in the specification and claims, the singular forms "a", "an" and "the" include plural references unless the context clearly dictates otherwise. For example, the term "an article" may include a plurality of articles unless the context clearly dictates otherwise. Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the foregoing application that are not depicted on one of the described drawings. In the event such a component is described, but not depicted. In a drawing, the absence of such a drawing should not be considered as an omission of such design from the specification. While the specification concluded with the claims defining the features of the invention that are regarded as novel, it is believed that the invention will be better understood from consideration of the following description in conjunction with the drawings, in which like reference numerals are carried forward.

Figure 4:
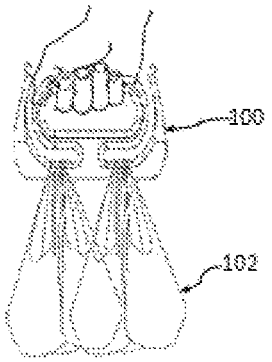
FIG. 4 is a perspective view of the device carrying a plurality of hand bags.

A perspective view of the device 100 for carrying a plurality of bags 102 (shown in FIG. 4) is shown in FIG. 1. The device is flat and can be of varying thickness based on the materials used, provided it is sufficiently sturdy so as to not bend with the weight of filled bags, preferably being able to sustain weights of greater than 20 lbs (9.1 kilos). Preferably it is about ¼" to about ¾" (0.63 cm to 1.9 cm) thick. While not meant to be limiting, an objective is for the present device to carry food and/or grocery bags purchased from supermarkets and the like, or consumer goods placed in plastic bags as shown in FIG. 4.

Figure 5:
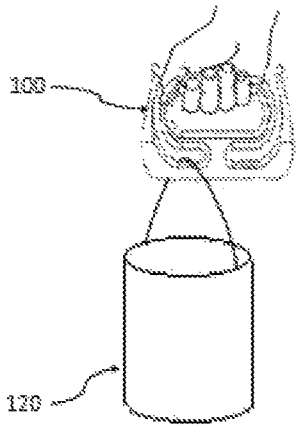
FIG. 5 is a perspective view of the device carrying a paint-can.

It will be appreciated by those skilled in the art, however, that device 100 could also be used to carry any number of different items having at least one handle or strap capable of being received by device 100, such as paint cans 120 as shown in FIG. 5, bug sprays with a handle, reusable bags, purses, wire, plastic and other types of clothes hangers, etc. Also, the inventive device is useful for easily carrying rectangular hay bales having ties or wires, Freon or propane tank cans, five gallon buckets, feed buckets, water pails, hanging plants, extension cords which can be wound onto the device for ease in carrying and storing, and is useful for organizing and carrying hanging horse bridles. Current devices found in the art are not generally useful devices for carrying such a variety of items as discussed herein.

Figure 2:
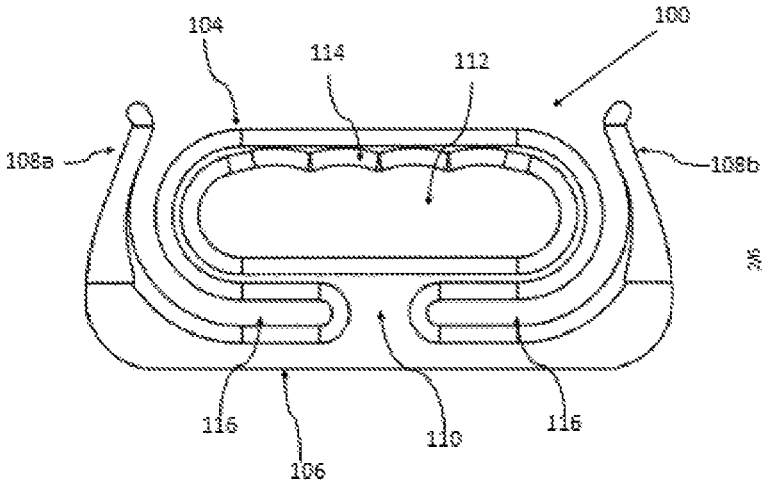
FIG. 2 is a side view of the device for carrying the plurality of hand bags.

A side view of the device 100 is shown in FIG. 2. The device 100 comprises a handle portion 104, an elongated portion 106 and a pair of hooks 108 (a and b) integrated on opposite sides of the device 100.

The device 100 is made of a monolithic (one piece) structure, i.e., the handle 104, the elongated portion 106 and the pair of hooks 108 are made of a single piece of material. Optionally the device 100 can be made of multiple pieces which are secured together by methods known in the art. Such methods include snapping together, securing with clips or nails/screws of some type, or the like. The monolithic device can be made by injection or cast molding, or manufactured by cutting out of pieces of plastic sheets. When in use, the handle portion 104 is at the top, the elongated portion 106 is at the bottom, with bags hanging therefrom. The handle portion 104 and the elongated portion 106 are connected through a middle portion 110.

The handle portion 104 defines an opening 112 in the center. The opening 112 is configured to receive fingers of a person's hand there through. The handle portion 104 further includes a grip 114. As shown in FIG. 2, the grip 114 is configured in an indented fashion for receiving fingers of the person using the device. The person then places the bags over the hooks 108*a* and 108*b*, and carries the device and bags.

The grip 114 has a profile that allows for the natural reception of fingers, thus making the device 100 comfortable to hold as shown in FIG. 4. This is advantageous whenever a load must be carried for any extended period of time or distance. In an example, the grip 114 can be provided with padding (not shown in the figures). Alternatively, and not shown in the figures, the grip 114 can be without indentations and have a smooth, straight line or downwardly curved grip. The handle 104 can also be straight or upwardly curved.

Figure 3:
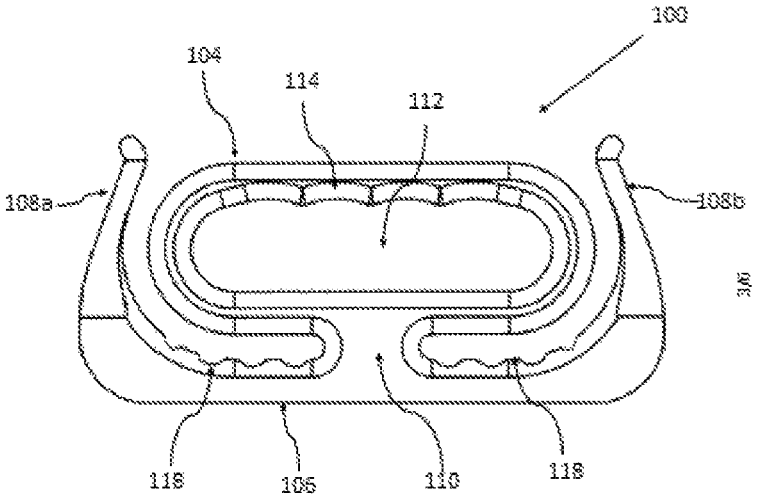
FIG. 3 is a side view of the device with ridges for ease in carrying a plurality of hand bags.

The elongated portion 106 is a horizontal structure with a flat design as shown in FIG. 2, or can be elongated with indentations for receiving the handles of bags, as shown in FIG. 3. The device 100 is also provided with a space 116 between the elongated portion 106 and the hook portions 108*a* and 108*b*.

The space 116 is present on the either side of the middle portion 110. The space 116 is configured to hold the plurality of bags. The width of the space can range from approximately ⅛" to about 1 inch (0.317 to 2.54 cm), with a preferred space being about ½ inch (1.27 cm). However, the optimum width will depend in part on the overall size of the device 100 and the width of the hooks 108*a* and *b*. Space 116 should not be so narrow so as to not allow free entry of the straps of the bags, nor too wide so as to weaken the hooks and make it easy for the hooks to get snagged and break off.

Figure 6:
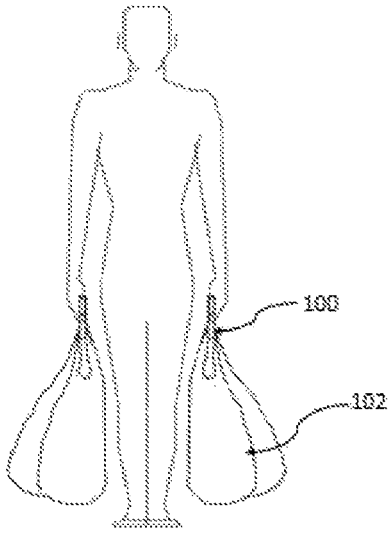
FIG. 6 is a front view of a person holding a device carrying a plurality of hand bags parallel to the body of the person.

In an example, shown in FIG. 6, the device 100 is used for carrying four hand bags 102. The flat design of the device 100 allows the plurality of hand bags 102 to be carried parallel to the body of the person. Thus, ergonomically helping the person to carry the plurality of hand bags 102 without causing discomfort to the person.

The plurality of hooks 108, i.e., a first hook 108*a* and a second hook 108*b* are longitudinally present on the opposite sides of the elongated portion 106. The first hook 108*a* and the second hook 108*b* are extended from the elongated portion 106 and angled upwardly at about a 90° angle up to the height of the upper edge of the handle portion 104.

The height of the hooks can vary from about half the height of the device 100, to about ½ inch (1.27 cm) above the handle 104. Preferably the hooks are about the height or slightly above the height of the handle 104. In the figures herein, the hooks extend to a height above the handle portion 104. The first hook 108*a* and the second hook 108*b* are configured to receive the plurality of handbags 102 and retain the handbags 102 in the space 116. The first hook 108*a* and the second hook 108*b* allow a smooth entry of the plurality of hand bags 102 inside the space, without any need for guiding of the bags. The design of the device 100 provides enhanced ergonomics and stability to the person while carrying the heavy loads for longer duration, or multiple trips carrying the load. While the figures show the first hook 108*a* and the second hook 108*b* are symmetrical with one another, an alternative is to have the hooks be asymmetrical. A perspective view of the device 100 along with a plurality of ridges 118 is shown in FIG. 3.

In this embodiment, the plurality of ridges, or indentations, 118 are present on the upper side of elongated portion 106 and on the small region on the first hook 108*a* and the second hook 108*b*.

The plurality of ridges 118 are configured to secure the position of the plurality of bags 102 when the person is moving. It should be appreciated that the plurality of ridges 118 can also be present along the entire length of the first hook 108*a* and the second hook 108*b*. Also, while three ridges are shown, any number of ridges may be provided depending on the number of bags to be carried. The ridges can also secure more than one bag per ridge depending on the depth of the ridge. Ridge depth can vary from a slight indentation or curvature, to about a ¼" (0.635).

The device 100 can be constructed of materials which provide for a rigid or semi-rigid construction, such as polyamides, or nylon 101, Acrylonitrile Butadiene Styrene (ABS), polypropylene, polyethylene, acetal- or acrylic-molecule materials or any other suitable plastic or polymeric material having the desired characteristics.

It can also be made of wood, or metals such as aluminum or stainless steel. Nylon or rigid plastic is the preferred material. The thickness of the device when using metals, is generally less than when using plastic type materials. For example, a prototype of aluminum was made wherein the device was approximately ⅛" (0.317 cm) thick by about 8" (20.320 cm) wide (measured from hook to hook). The aluminum construction device felt thin and uncomfortable to use, but was not optimized due to cost considerations. An alternate plastic prototype was made of acrylic material having about a ¾" (1.90 cm) thickness by about 7" (17.780 cm) in width (as measured from hook to hook). This was found to be more comfortable to hold compared to the aluminum metal device. Different prototypes were made varying the size and width of the device, the indentations on the handle 104, and elongated lower end 106, and the curvature of the grip 114, and varying the materials. Ultimately, the device 100 is lightweight to carry and is conveniently sized to be carried in a pocket when not in use. While the size dimensions may vary, it was found that about 4"×8" (10.16 cm×20.32 cm) is a good fit for carrying to market, placing in the pockets of a pair of pants, or placing in a purse for transport and later use. Preferably the device 100 has high tensile strength when made of HDPE. See attached table of Hitec brand high density polyethylene (HDPE) for typical properties thereof which transfer onto the device when made of HDPE. Preferably the device is made of about ⅔ polypropylene, ⅓ fiberglass, and by injection molding.

The device was found to have a psi of about 1000-1500 (psi) at room temperature when made of acrylic material. The strength of the device 100 can also be further increased by using standard fillers. The device 100 has been shown as having an integral construction wherein all of its constituent parts are integrally formed. According to an embodiment of the disclosure, the device 100 could be constructed by well-known injection molding techniques. It will be appreciated, however, that such an integral construction is not essential to the spirit and scope of the present invention.

The maximum number of bags capable of being carried by the device 100 will depend on multiple factors such as the weight and size of the bags. It should be appreciated that the device 100 can also be used to carry a load having unequal weight distribution by having the person shift his fingers along the length of the grip 114 in the appropriate direction to leverage the unequal weight distribution. It was found that an acrylic device 100, about 8"×4"×1" (20.32 cm×10.16 cm×2.54 cm) can carry weight loads of up to about 500-600 lbs (226 kilos-272 Kilos), with the maximum being dictated by the amount a person can carry, rather than the weight that the device can carry without breaking. It is desired that the carrier be able to hold at least about 20 lbs (9 kilos) of weight without substantial deformation. Here substantial deformation is defined to mean no bending other than slight, or up to about 20% deformation compared to a carrier without any weight.

Modifications to the device include removing an amount of construction material to lighten the weight of the device yet have it remain sufficiently rigid to allow for carrying items and not substantially deforming. The handles can be wider if desired to allow heavier commercial-sized items to be carried. Accessories for the inventive device include building into the device items for convenience to the user such as a flashlight or light, a can opener, a hanger to allow hanging the device conveniently, a hanger to accommodate a clothes pole (such as for hanging clothes in a car), and other such items as desired by the user.

While the invention has been described in detail, modifications within the spirit and scope of the invention will be readily apparent to those of skill in the art. In addition, it should be understood that aspects of the invention and portions of various embodiments may be combined or interchanged either in whole or in part.

Furthermore, those of ordinary skill in the art will appreciate that the foregoing description is by way of example only, and is not intended to limit the invention.

Although selected embodiments have been illustrated and described in detail, it may be understood that various substitutions and alterations are possible. Those having ordinary skill in the art and access to the present teachings may recognize additional various substitutions and alterations are also possible without departing from the spirit and scope of the present invention, and as defined by the following claims.

| TYPICAL PHYSICAL PROPERTIES | Nominal Value | Units | ASTM Test Method |
|---|---|---|---|
| Melt Index | 0.80 | g/10 min | D 1238 |
| Density | 0.960 + | g/cm$^3$ | D 1505 |
| Tensile Strength @ Yield | 4,600 | psi | D 638 |
| Elongation @ Break | >600 | % | D 638 |
| Coefficient of Linear Thermal Expansion | $6 \times 10^{-5}$ | In./in./° F. | D 696 |
| Flexural Modulus | 225,000 | psi | D 790 |
| Tensile Impact | 120 | fl-lb/in | D 1822 |
| Low Temperature Brittleness $F_{50}$ | <−76 | ° C. | D 746 |
| Heat Deflection Temperature @ 66 psi | 82 | ° C. | D 648 |
| Maximum Service Temperature, Air | 180 F. | | Long Term |
| Vicat Softening Point | 129 | ° C. | D 1525 |
| Hardness, Shore D | 69 | | D 2240 |
| Absorption | Max 0.01% | | D5709(2) |
| Flammability Rating | UL94 HB | | |
| Compliances | FDA, USDA, NSF | | |

Table of typical physical properties of Hitec brand high density polyethylene.

What is claimed is:

1. A holder for carrying a plurality of handbags, the holder comprising:

a handle defining an opening for receiving a plurality of fingers of a person's hand therein;

a middle portion having a first end and a second end, wherein the first end of the middle portion is integrated with the handle;

an elongated portion integrated with the second end of the middle portion, wherein the elongated portion is parallel to a length of the handle, and wherein a length of the elongated portion is greater than the length of the handle; and a pair of hooks including a first hook and a second hook integrated with opposite longitudinal ends of the elongated portion such that a space is defined between the handle and the elongated portion, and between the handle and the first and second hooks, wherein the first hook and the second hook are angled upwardly to extend at least half way up to a height of the handle, and wherein the first hook and the second hook each are configured for smoothly receiving the plurality of handbags and retaining the plurality of handbags in the space, such that the plurality of handbags rest on the elongated portion and remain parallel to a body of the person carrying the holder.

2. The holder of claim 1, wherein the handle includes a grip, and wherein the grip is indented for resting the plurality of fingers of the person for holding the handle.

3. The holder of claim 1, wherein the first hook and the second hook are symmetrical with respect to each other.

4. The holder of claim 1, wherein the holder is made of at least one of wood, Nylon 101, aluminum, plastic, Acrylonitrile Butadiene Styrene (ABS), polypropylene fiberglass, polypropylene, and HDPE.

5. The holder of claim 1, wherein the first and second hooks receive a plurality of items in the space, and wherein each item of the plurality of items includes a metal wire handle.

6. The holder of claim 1, wherein the holder is used to carry plastic bags, clothes hangers, purses, paint cans, hay bales, and buckets.

7. The holder of claim 1, wherein the holder is made of ⅔ polypropylene and ⅓ HDPE fiberglass.

8. The holder of claim 1, wherein the elongated portion includes a plurality of ridges for securing the plurality of handbags in the plurality of ridges.

9. The holder of claim 8, wherein each ridge of the plurality of ridges has a depth of up to one quarter of an inch.

* * * * *